US006452551B1

(12) United States Patent
Chen

(10) Patent No.: US 6,452,551 B1
(45) Date of Patent: Sep. 17, 2002

(54) CAPACITOR-LOADED TYPE SINGLE-POLE PLANAR ANTENNA

(75) Inventor: I-Fong Chen, Tao-Yuan (TW)

(73) Assignee: Auden Techno Corp. (TW)

( * ) Notice: Subject to any disclaimer, the term of this patent is extended or adjusted under 35 U.S.C. 154(b) by 0 days.

(21) Appl. No.: 09/919,945

(22) Filed: Aug. 2, 2001

(51) Int. Cl.[7] ..... H01Q 1/38; H01Q 1/24
(52) U.S. Cl. ..... 343/700 MS; 343/702
(58) Field of Search ..... 343/700 MS, 702, 343/745, 749, 841, 895

(56) References Cited

U.S. PATENT DOCUMENTS 6,204,826 B1 * 3/2001 Rutkowski et al. ..... 343/895
6,259,029 B1 * 9/2001 Chen et al. ..... 343/700 MS
6,337,663 B1 * 1/2002 Chi-Minh ..... 343/702
6,342,859 B1 * 1/2002 Kurz et al. ..... 343/702
6,353,443 B1 * 2/2002 Ying ..... 343/702

* cited by examiner

*Primary Examiner*—Tan Ho
(74) *Attorney, Agent, or Firm*—Troxell Law Office PLLC

(57) ABSTRACT

A capacitor-loaded type single-pole planar antenna, the antenna has a base installed on a non-electric conductive housing of a communication equipment with a metal shield inside, the base has a surface of a desired area, a tortuous low band antenna with a total length of ¼λ of 900 MHz is provided on the surface, the low band antenna contains an open circuit end and a feed end, the feed end is driven by an interior RF circuit of the communication equipment, a capacitor and an open stub with a total length of ¼λ of 1800 MHz and functioning as a high band antenna are installed on the tailing end of the low band antenna. Thus a dual-frequency planar antenna which can be directly installed on the surface of the housing of the communication equipment such as a mobile phone in a completely flat mode is accomplished.

8 Claims, 3 Drawing Sheets

CAPACITOR-LOADED TYPE SINGLE-POLE PLANAR ANTENNA

BACKGROUND OF THE INVENTION

1. Field of the Invention

The present invention is related to a capacitor-loaded type single- pole planar antenna; and especially to such a planar antenna suitable for sticking as a plane on the surface of the housing of communication equipment such as a mobile phone, functioning as a dual-frequency transceiver antenna.

2. Description of the Prior Art

As the mobile phones were emerged in the markets in early days, most of them used exposed coils of spiral structure as the main elements of antennas. These coil antennas used widely nowadays are divided into two major types—contractible type and fixed type. No matter what type of structure is used, under normal circumstances, it still protrudes with a specific length out of the body's top surface of a mobile phone. The conventional coil antennas become more and more unsuitable for the design requirement of the miniaturized mobile phones, hence microstrip antennas have been developed. Because the characteristics of the microstrip antennas are flatness and small space demanding, such antennas certainly will become the mainstream products for the miniaturized mobile phones.

A microstrip antenna of the early stage, as disclosed in U.S. Pat. No. 3,921,177 or 3,810,183, usually consists of a round or rectangular thin metal sheet, and dielectric substance is stuffed between it and the ground; but these microstrip antennas are only compatible with narrower bandwidths. Taiwan Patent No. 81108896 (U.S. Patent Application Ser. No. 07/798700) provided a microstrip antenna with diminished size and broadband, however the defects of this kind of antenna are to install the spiral antenna elements on separate ground boards, and to stuff dielectric and loading material of specific thickness between them. The size of the whole antenna was still hard to be further reduced.

And if the antenna is installed on the housing of a set of communication equipment, it will cause an end leakage and thus generate an end effect between the planar antenna and the interior grounding metal shield used for preventing electromagnetic interference (EMI) inside the communication equipment. Generally speaking, the larger the distance between the antenna and the grounding metal shield is, the more obvious end effect shows, the harmonic oscillation frequency of the antenna accordingly is lowered, this has become the problem yet to be solved.

SUMMARY OF THE INVENTION

The prime object of the present invention is to provide a capacitor-loaded type single-pole planar antenna, which can be stuck flatly on the housing of the communication equipment as a transceiver antenna of 900 MH and 1800 MHz.

In order to achieve the above mentioned object, the present invention is made a capacitor-loaded type single-pole planar antenna by processing the ¼λ antenna which is a low band antenna to make its predetermined length tortuous in pursuance of the size of the installation space for it, and by connecting a capacitor with a minimal capacity value to a length of open stub used as an impedance matching adjuster and being able to increase the bandwidth at the tailing end of this low band antenna. Then, when the band is mainly 900 MHz, the open stub and the capacitor with the minimal capacity value will be the capacitor loaded circuit, and if the band is mainly 1800 MHz, the low band antenna and the capacitor with the minimal capacity value will be the capacitor loaded circuit, so as to be suitable for two different frequencies 900 MHz and 1800 MHz.

The novelty and other features of the present invention will be apparent after reading the detailed description of the preferred embodiment thereof in reference to the accompanying drawings.

DETAILED DESCRIPTION OF THE PREFERRED EMBODIMENT

Figure 1:
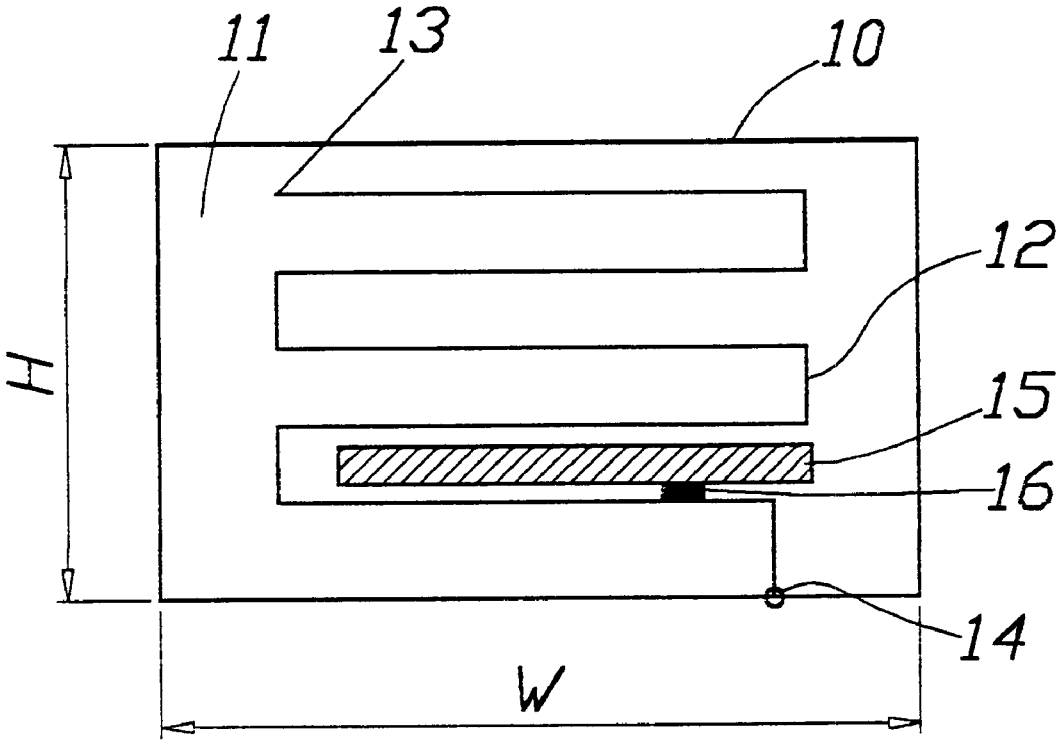
FIG. 1 is a perspective view of a preferred embodiment of the present invention.

Referring to FIG. 1 first of all, the present invention has a base 10 made of suitable material. The base 10 forms a surface 11 with a desired area. Take the communication equipment of the mobile phone as an example, if the horizontal width of the housing is 5 cm, then the base 10 can be have a width of about 2.5 cm to match the long side H which is smaller than the width W, and together to form the desired surface area.

The abovementioned surface 11 of the base 10 of the present invention as shown in the preferred embodiment is installed with a low band antenna 12. Since a general microstrip antenna opens its circuit at the front end 13 of the microcircuit, this portion is used as an antenna; while radiation depends on harmonic oscillation which is related to the length of the antenna. Because of this, the length of the harmonic oscillation of the low band antenna 12 of the present invention adopts ¼λ too. But in corresponding with the size of the installation space, the total length (with a center frequency of 925 MHz) of the entire low band antenna 12 designated as 900 MHz×¼λ is installed in a tortuous way. That is to say, the total desired length as shown in the preferred embodiment includes a serially bended line. The other end 14 which is opposite to the front open circuit end 13 extends to the end edge of the base 10 functioning as a feed end. Although the low band antenna 12 is installed in a tortuous way, it still is used as an Omni-directional antenna.

In the abovementioned serially bended low-band antenna 12 as shown in the preferred embodiment, an open stub 15 can be provided in a gap space between two confronting bending sections as a high band antenna. The total length of the open stub is ¼λ of 1800 MHz (with a center frequency of 1795 MHz). A capacitor 16 with a minimal capacity value (PF class, 10 PF is adoptable in this invention) is connected between the tailing end of the low band antenna 12 and the open stub 15, the capacitor 16 is installed in a high band (preferably to be installed at the location λ/16 of the open stub) and becomes a capacitor-loaded type single-pole planar antenna. The open stub 15 as mentioned above not only functions as an impedance matching adjuster, but also increases bandwidth effectively.

Figure 4:
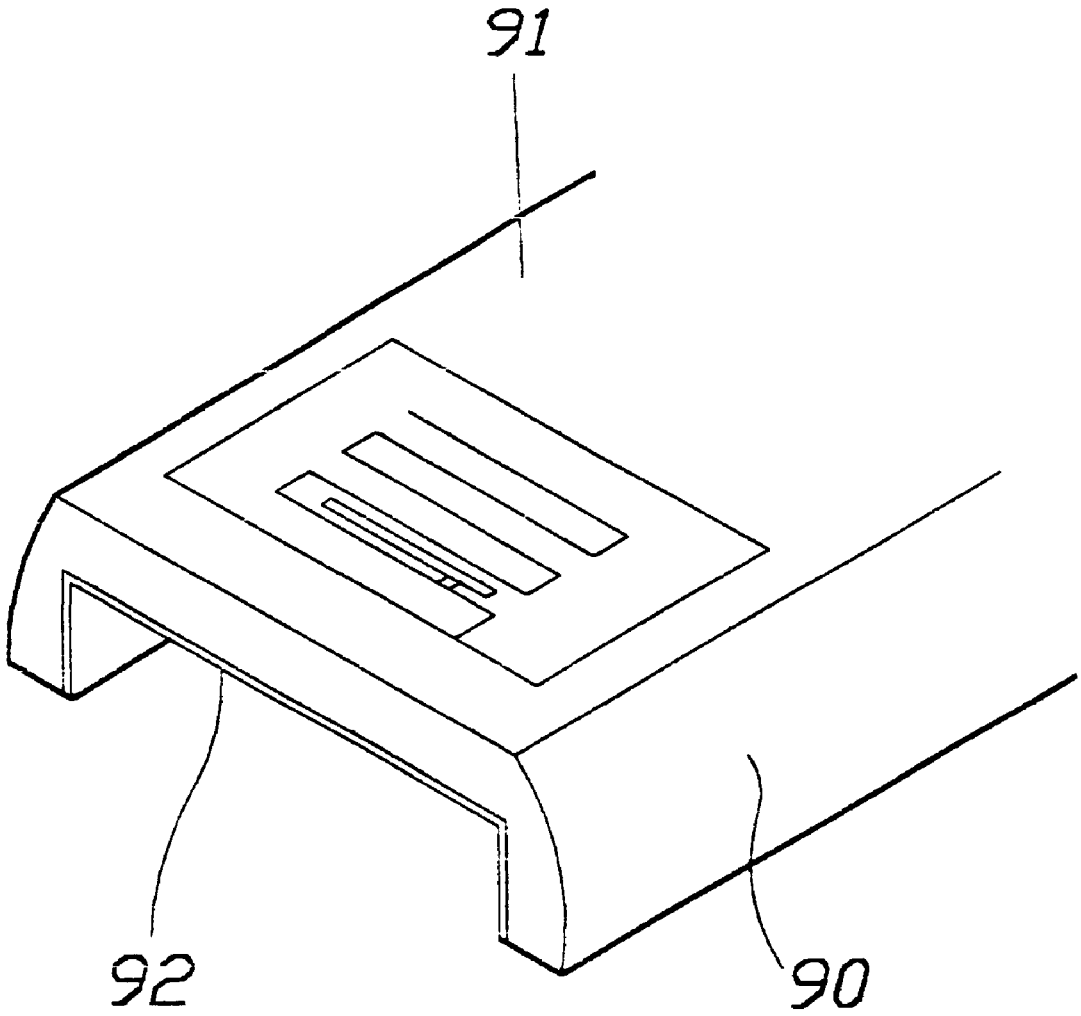
FIG. 4 is a schematic perspective view showing installation of the embodiment of FIG. 1 on the housing of the communication equipment.

The abovementioned planar antenna including the entire base 10 and its surface 11 is not necessary to be grounded on the back, since in general, there is a ground metal shield inside of the communication equipment for preventing electromagnetic interference. As shown in FIG. 4, the present invention is installed on the housing 91 (the back surface of the body) of the communication equipment 90 such as a mobile phone. The abovementioned feed end 14 of this planar antenna can connect a wireless RF circuit (not shown) inside the equipment. Under the above mentioned assembly circumstances, since the housing of this kind of communication equipment is shaped using plastic in general, that is, after this planar antenna is installed on the housing of the communication equipment, the non-electric conductive material (that is the plastic housing 91) exists between the planar antenna and the metal shield 92 inside the communication equipment.

After installation of the abovementioned planar antenna, an end leakage is created and an end effect is generated between the antenna circuit and the metal shield 92 by that the electric field of the antenna constantly radiates outward. To speak in common sense, the larger the distance between the antenna and the metal shield 92 is, the more obvious end effect it shows, this lowers the harmonic oscillation frequency. However, the present invention can reduce the frequency-drifting phenomenon as mentioned above by connecting serially a capacitor 16 with the minimal capacity value and an open stub 15 at the tailing end of the low band antenna 12.

Figure 2:
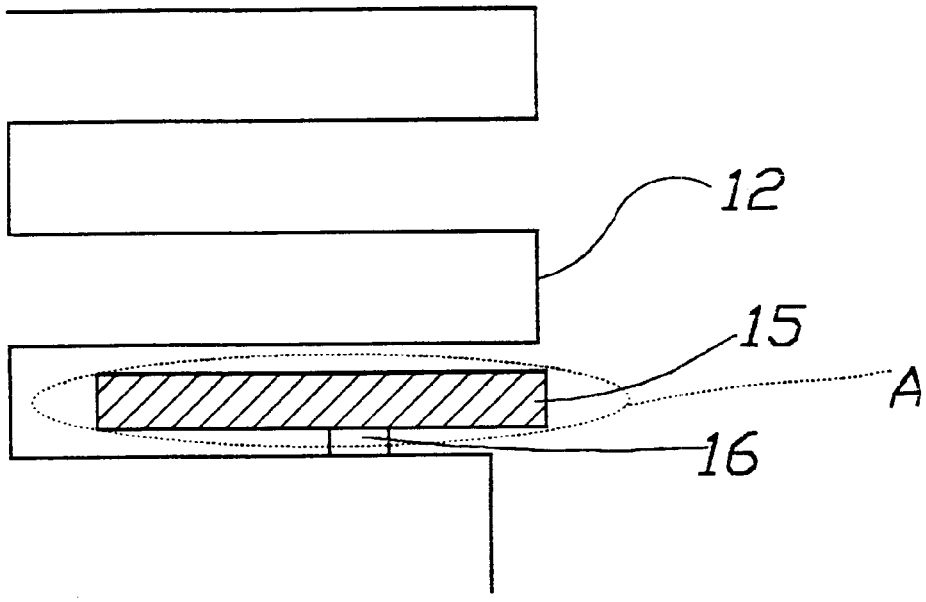
FIG. 2 is a schematic sectional view showing the principle of function when the band of the antenna in FIG. 1 is mainly 900 MHz.
Figure 3:
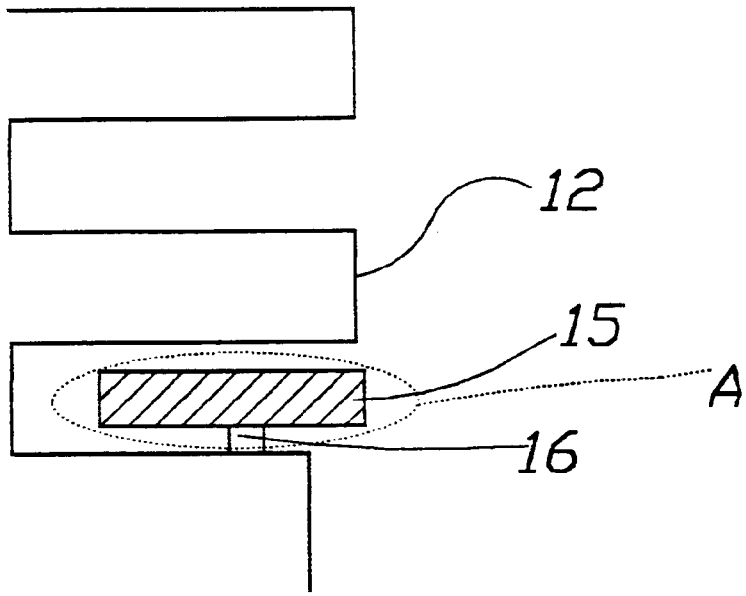
FIG. 3 is a schematic sectional view showing the principle of function when the band of the antenna in FIG. 1 is mainly 1800 MHz.

The open stub of the present invention is devised as a part of the capacitor-loaded circuit so as to achieve the functioning principle of a dual-frequency antenna as shown in FIG. 2 and FIG. 3. When the frequency is mainly 900 MHz, the capacitor 16 and the open stub 15 of the portion "A" as shown in FIG. 2 will become a capacitor-loaded circuit, and the low band antenna 12 will be a transceiver antenna of 900 MHz. If the frequency is mainly 1800 MHz, the low band antenna 12 and the capacitor 16 of the portion "B" as shown in FIG. 3 will become a capacitor-loaded circuit, and the open stub 15 will be a transceiver antenna of 1800 MHz.

The capacitor-loaded type single-pole planar antenna with the above mentioned structure of the present invention entirely occupies no existing space of the communication equipment such as a mobile phone. It can be installed on the surface of the housing of the communication equipment almost in a completely flat mode to function as dual-frequency transceiver antenna. Not only the antenna can be assembled completely without obstacle outside of the communication equipment to make the assembling work more prompt and convenient, but also can be more superior in suiting the miniaturized mobile communication equipment.

The above stated preferred embodiment is only for illustrating the present invention. It will be apparent to those skilled in this art that various modifications or changes can be made to the elements of the present invention without departing from the spirit and principle of this invention and fall within the scope of the appended claims.

What is claimed is:

1. A capacitor-loaded type single-pole planar antenna, said antenna has a base which is installed on a non-electric conductive housing of a communication equipment with a metal shield inside, said base has a surface of a desired area, a tortuous low band antenna with a total length of ¼λ of 900 MHz is provided on said surface, said low band antenna contains an open circuit end and a feed end, said feed end is driven by an interior RF circuit of said communication equipment, a capacitor and an open stub with a total length of ¼λ of 1800 MHz and functioning as a high band antenna are installed on the tailing end of said low band antenna.

2. A capacitor-loaded type single-pole planar antenna as claimed in claim 1, wherein, said capacitor is installed at a location λ/16 of said open stub of said high band antenna.

3. A capacitor-loaded type single-pole planar antenna as claimed in claim 2, wherein, said capacitor is one with a minimal capacity value of PF class.

4. A capacitor-loaded type single-pole planar antenna as claimed in claim 1, wherein, said capacitor is one with a minimal capacity value of PF class.

5. A capacitor-loaded type single-pole planar antenna as claimed in claim 1, wherein, said open stub is installed in a gap space between two confronting bending sections of a serial bending line of said low band antenna.

6. A capacitor-loaded type single-pole planar antenna as claimed in claim 5, wherein, said capacitor is installed at a location λ/16 of said open stub of said high band antenna.

7. A capacitor-loaded type single-pole planar antenna as claimed in claim 6, wherein, said capacitor is one with a minimal capacity value of PF class.

8. A capacitor-loaded type single-pole planar antenna as claimed in claim 4, wherein, said capacitor is one with a minimal capacity value of PF class.

* * * * *